US008360800B1

(12) United States Patent
Finona

(10) Patent No.: US 8,360,800 B1
(45) Date of Patent: Jan. 29, 2013

(54) MULTI-POLARIZED CONNECTOR

(75) Inventor: Michael Santos Finona, Lake Forest, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 13/281,128

(22) Filed: Oct. 25, 2011

(51) Int. Cl.
*H01R 13/64* (2006.01)

(52) U.S. Cl. ..... 439/378

(58) Field of Classification Search ..... 439/378, 439/381, 680, 157, 55, 137
See application file for complete search history.

(56) References Cited

U.S. PATENT DOCUMENTS

| | | | | | |
|---|---|---|---|---|---|
| 3,177,462 | A | * | 4/1965 | Sarnmark | 439/681 |
| 3,287,031 | A | * | 11/1966 | Simmons et al. | 285/27 |
| 3,853,381 | A | * | 12/1974 | Morningstar | 439/364 |
| 4,518,212 | A | | 5/1985 | Rumble | |
| 4,580,868 | A | * | 4/1986 | Verstijnen | 439/680 |
| 4,619,640 | A | * | 10/1986 | Potolsky et al. | 604/7 |
| 4,647,130 | A | * | 3/1987 | Blair et al. | 439/248 |
| 4,736,999 | A | | 4/1988 | Marks et al. | |
| 4,820,204 | A | * | 4/1989 | Batty | 439/681 |
| 4,915,641 | A | * | 4/1990 | Miskin et al. | 439/247 |
| 4,938,707 | A | * | 7/1990 | Guimond et al. | 439/218 |
| 5,376,016 | A | * | 12/1994 | Inaba et al. | 439/364 |
| 5,888,101 | A | * | 3/1999 | Dent et al. | 439/680 |
| 5,902,155 | A | * | 5/1999 | Polgar et al. | 439/680 |
| 6,773,286 | B1 | * | 8/2004 | Wu | 439/247 |
| 6,796,849 | B2 | | 9/2004 | Villain | |
| 6,994,595 | B2 | * | 2/2006 | Baker et al. | 439/680 |
| 7,144,262 | B2 | | 12/2006 | Cheng | |
| 7,311,526 | B2 | | 12/2007 | Rohrbach et al. | |
| 7,520,536 | B2 | * | 4/2009 | Tiberghien et al. | 285/93 |
| 7,645,143 | B2 | | 1/2010 | Rohrbach et al. | |
| 7,690,937 | B2 | * | 4/2010 | Daily et al. | 439/290 |
| 7,749,016 | B2 | * | 7/2010 | Ikeya et al. | 439/364 |
| 7,762,857 | B2 | * | 7/2010 | Ngo et al. | 439/856 |
| 2011/0039435 | A1 | | 2/2011 | Huang | |

* cited by examiner

*Primary Examiner* — Alexander Gilman
(74) *Attorney, Agent, or Firm* — Leon D. Rosen

(57) ABSTRACT

A pair of electrical connectors (10, 12) can be mated by inserting a pair of guide pins (50*a*, 50*b*) lying on side axes (22, 24) of a first connector, into a pair of guide sleeve passages (70*a*, 70*b*) that lie on side axes of a second connector. The first and second connectors each can be adjusted to laterally shift front parts of the guide pins and front parts of the guide sleeves, so the distance A' between the two pins and the distance B' between the two sleeves is slightly reduced or slightly increased to prevent one of the connectors from mating with a third connector.

6 Claims, 4 Drawing Sheets

MULTI-POLARIZED CONNECTOR

BACKGROUND OF THE INVENTION

A communications manager, such as a military officer or technician, sometimes must set a particular plug connector and a particular socket connector so they mate only with each other and not with similar connectors. Such setting of mating connectors so only the selected pair of connector mate, sometimes must be done in the field, so the setting should be accomplished as easily as possible.

SUMMARY OF THE INVENTION

In accordance with one embodiment of the invention, connectors are provided that can be set to mate only with correspondingly set connectors, Each connector has a pair of side axes that are spaced apart and lie on opposite sides of the connector housing axis. A first connector has a pair of pins with pin front ends projecting forwardly at each of its side axes and a second connector has a pair of sleeves with sleeve front ends projecting forwardly at each of its side axes. The two connectors will mate only if the distance between the forward ends of the pins and the distance between the forward end of the sleeves are precisely equal so the pins easily fit into the sleeves.

Each of the pins has a threaded rear end that screws into a pin receiver that is precisely aligned with the corresponding side axis. Each pin also has a forward-projecting part that is offset from the corresponding side axis by a predetermined amount. As a result, the distance between the two pin forward-projecting parts can be adjusted by turning the pins to different rotational orientations.

Each of the sleeves has a threaded rear end that screws into a sleeve-receiver that is aligned with the corresponding side axis. Each sleeve also has walls forming a forward-projecting passage with a passage axis that is offset from the corresponding side axis by said predetermined amount. As a result, the distance between the two sleeve forward-projecting parts can be adjusted by turning the sleeves to different rotational positions. Only if the distance between the two pin forward parts and the distance between the two sleeve passages are the same, will the two connectors mate.

Each pin receiver has a plurality of radial recesses and each pin has a radial projection that projects into a selected recess. When the pin is turned so its projection projects into a particular recess, this determines the direction of offset of the pin forward part from the side axis. Each sleeve is similarly constructed to determine its direction of offset.

The novel features of the invention are set forth with particularity in the appended claims. The invention will be best understood from the following description when read in conjunction with the accompanying drawings.

DESCRIPTION OF THE INVENTION

Figure 1:
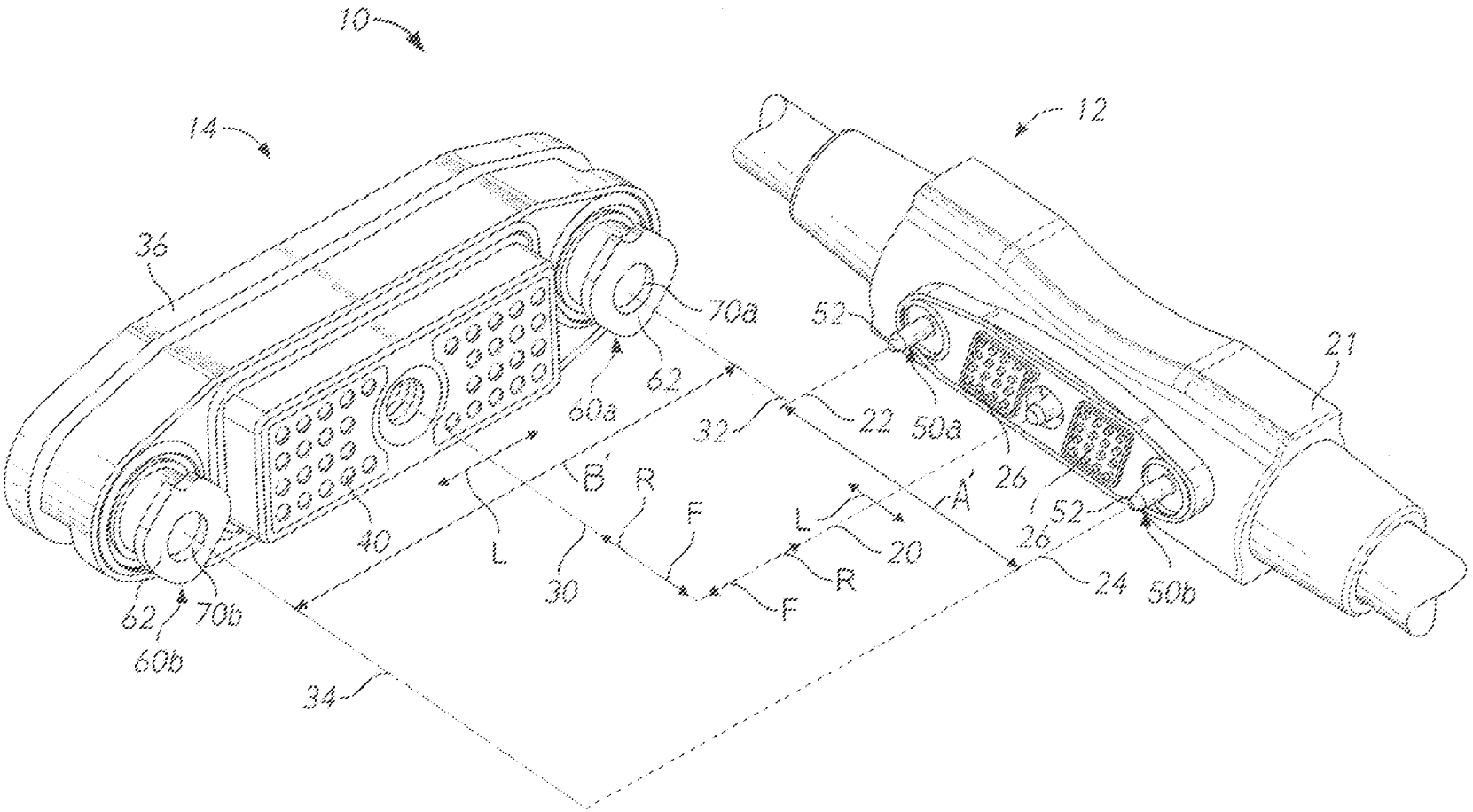
FIG. 1 is an exploded view of a pair of connectors that are approaching each other to mate.

FIG. 1 shows an electrical connector system 10 which includes a plug connector 12 and a socket connector 14 that can mate with each other. The plug connector has a housing axis 20 extending in front-and-rear directions F, R relative to the plug connector housing 21. The plug connector also has a pair of side axes 22, 24 that are laterally L spaced apart, that extend parallel to the housing axis 20 and that are preferably substantially equally spaced from the housing axis. The plug connector has a plurality of signal contacts 26 that are arranged in rows and columns.

The socket connector 14 has a housing axis 30 and a pair of side axes 32, 34 that extend in front and rear longitudinal directions F, R relative to the socket connector housing 36. The side axes 32, 34 are laterally L spaced apart. The lateral directions L for the two connectors coincide when the connectors are mated. The socket connector has a plurality of signal contacts 40 arranged in rows and columns, that are designed to mate with the signal contacts of the plug connector.

Figure 2:
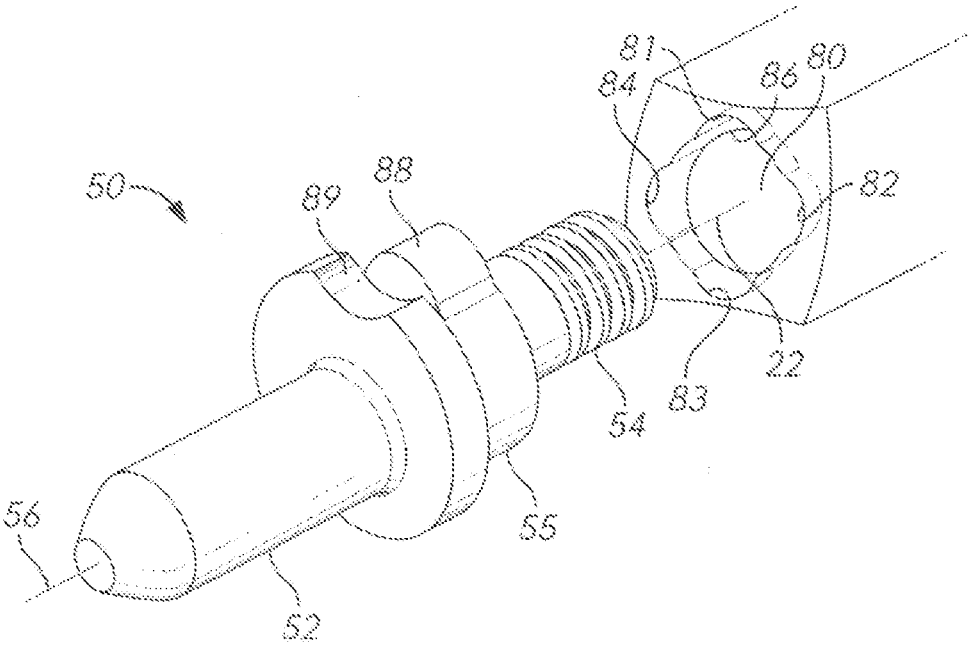
FIG. 2 is an isometric view of a guide pin of one of the connectors of FIG. 1.

The plug connector 12 has a pair of guide pins 50*a*, 50*b* with pin front ends 52. FIG. 2 shows that each guide pin 50 has a threaded rear mount part 54 that is centered on the corresponding side axis such as 22. The pin front end 52 has a front axis 56 that is offset a distance C (FIG. 3) radially with respect to the side axis 22. As a result, the precise position of the pin front end 52, that is, its distance from the side axis 22, depends upon the rotational position of the pin. Therefore, the lateral distance A' (FIG. 1) between pin front ends, depends on the rotational positions of the two pins.

Figure 4:
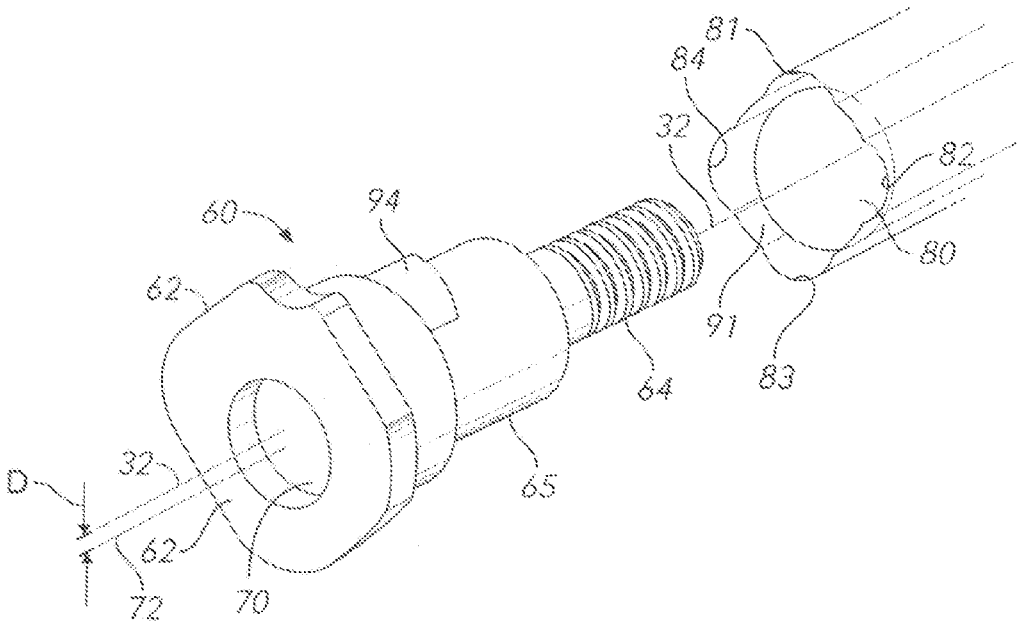
FIG. 4 is an isometric view of a guide sleeve of one of the connectors of FIG. 1.

The socket connector has a pair of guide sleeves 60*a*, 60*b* with sleeve front ends 62. As shown in FIG. 4, each guide sleeve has a threaded rear mount part 64 that is centered on the corresponding side axis such as 32. Each sleeve front end 62 has a passage 70 (preferably cylindrical) centered on a front axis 72 that is offset by a distance D from the corresponding side axis 32. As in the case of the plug connector, the lateral distance B' (FIG. 1) between the sleeve passages depends upon the rotational positions of the two guide sleeves.

Figure 3:
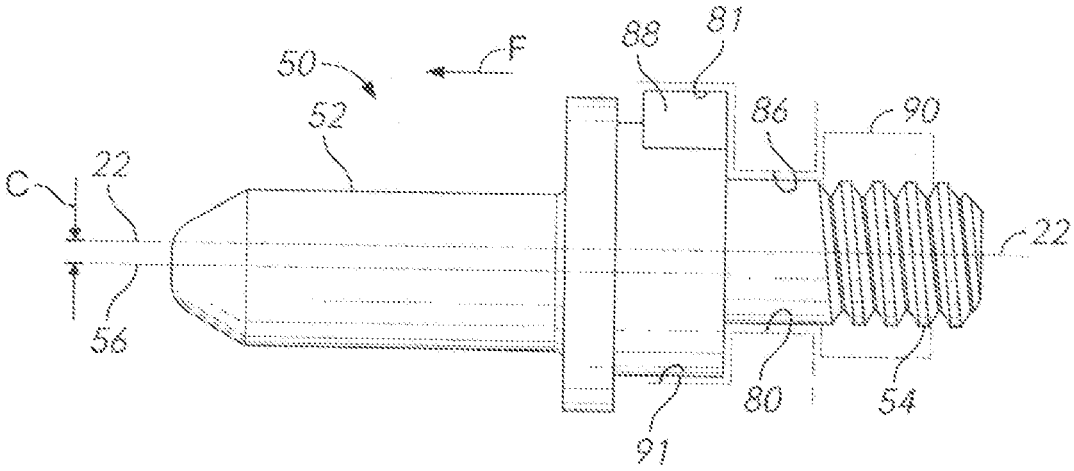
FIG. 3 is a side elevation view of the guide pin of FIG. 2, with the pin receiver of the housing shown in phantom lines.

As shown in FIGS. 2 and 3, the plug connector housing has a pin receiver or receiver part 80 for receiving the rear parts 54, 55 of the guide pins (or the rear parts 64, 65 of the guide sleeves). The receiver parts includes a cylindrical section 86 that closely receives the threaded rear mount part or shank 54 of the guide pin, and includes a rear part 91 with four radial recesses 81-84 that are equally angularly spaced about the side axes 22. The spacing can be 90°, 120° or other part of a circle. The guide pin has a radial projection 88 that fits into a selected one of the four radial recesses. A cutout 89 allows a person to see the projection 88 and to see a radial recess such as 81 in the housing.

Each guide pin is held in its housing by a nut 90 (FIG. 3) that is threaded onto the threaded rear mount part 54 until the guide pin is fixed in position. The nut can be loosened, the guide pin pulled forward and turned to a selected rotational position and then pushed rearward to move the radial projection 88 into a radial recess such as 82. The nut is tightened again. The guide pin radial projection 88 that fits into one of the radial recess 81-84, fixes the rotational orientation of the guide pin.

Figure 5:
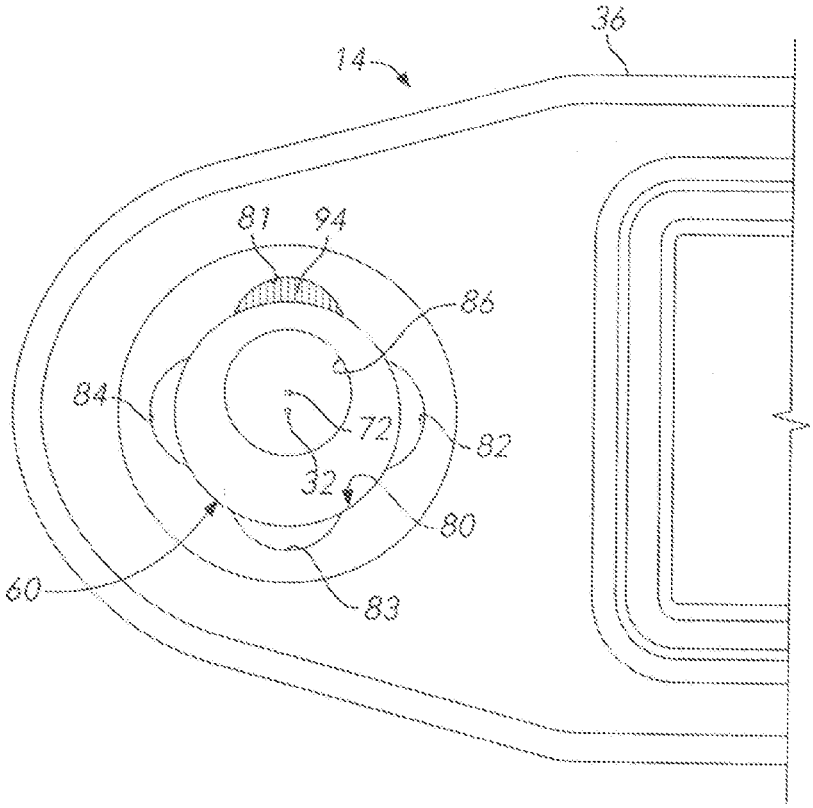
FIG. 5 is front view of one of the connectors of FIG. 1
Figure 6:
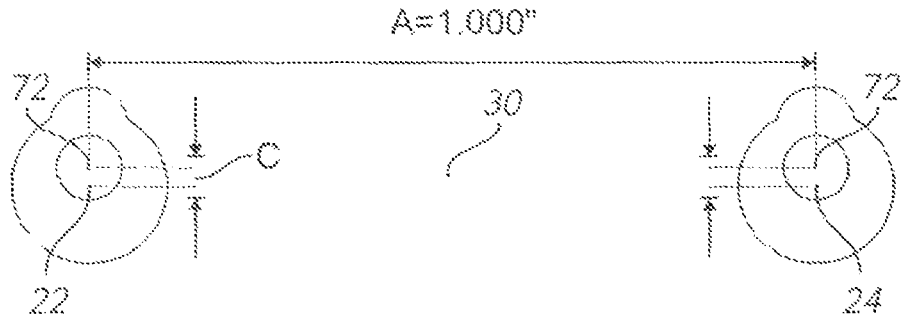
FIGS. 6 through 9 are diagrammatic views showing how rotation of guide pins affects their spacing.

FIG. 5 shows a guide sleeve 60 installed in the socket housing, showing the side axis 32 and showing the sleeve axis 72 of the guide sleeve offset from the side axis. The radial projection 94 of the sleeve is shown lying in the uppermost radial recess 81 so the sleeve axis 72 is offset upwards from the corresponding side axis 32 The radial recesses 81-84 and radial projection 94 are each part of a cylinder. FIG. 6-9 show the results of installing the guide sleeve in different rotational positions. FIG. 6 shows a case where the distance A between side axes 22, 24 is 1.000 inch.

Figure 7:
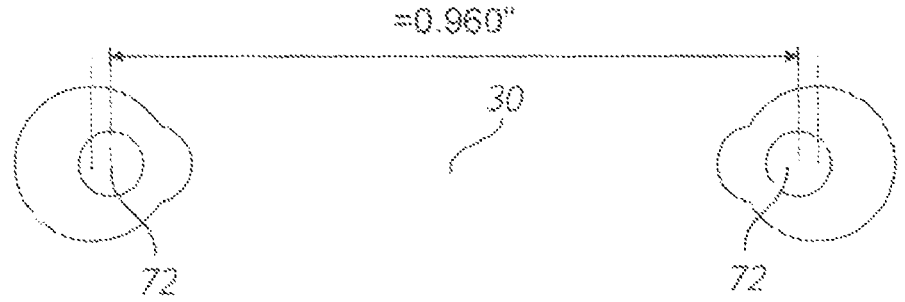
Figure 8:
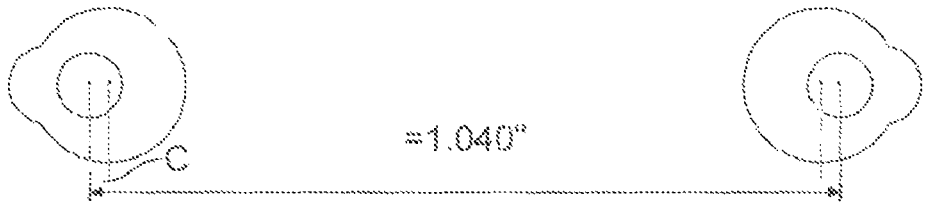

FIG. 7 shows a situation similar to that of FIG. 6, but with the guide sleeves each turned 90° in opposite directions so each sleeve axis 72 is closer to the housing axis 30. Where the offset C between the side axis and the sleeve passage axis is 0.020 inch, this results in the distance A in FIG. 7 between the two sleeve axes being decreased from 1.000 inch to 0.960 inch. This spacing of 0.960 inch prevents the socket connector from mating with a plug connector whose spacing between the pin front parts is 1.000 inch. To allow such mating, the pins must be turned 90° and be reinstalled. FIG. 8 shows an orientation of the sleeves to increase the distance between the pair of pin front part axes from 1.000 inch to 1.040 inch.

Figure 9:
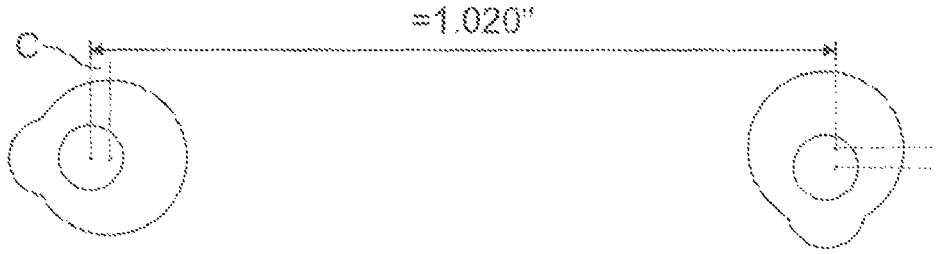

Applicant notes that in FIG. 6 both sleeve front parts have been raised by 0.020 inch, and in FIG. 9, only one of the sleeve front parts has been lowered by 0.02 inch, while increasing the lateral distance between sleeve front parts by 0.020 inch. In most cases this such slight raising or lowering will not interfere with mating of the signal contacts of the two connectors.

Thus, the invention provides a connector system that allows a precise change in the spacing between pin guide front ends and between sleeve guide front ends. Each guide front end has a pin front part or sleeve front part with an axis that is offset from a mount shaft on which a side axis lies. Each pin guide also has a radial projection that fits into one of a plurality of recesses to fix the orientation of the guide, to thereby fix the spacing between pin or sleeve guide front parts.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical connector system that includes first and second connectors (12, 14) wherein each of said first and second connectors can be adjusted in the field to be mateable to each other but not to other, similar connectors, wherein:

said first connector includes a first housing (21) with a forward-rearward (F, R) extending first housing axis (20), a plurality of signal contacts (26) arranged in a plurality of rows and columns, and a pair of laterally-spaced guide pins (50*a*, 50*b*) mounted on said first housing and extending primarily along side axes (22, 24) that are parallel to said first housing axis;

said second connector includes a second housing 36 and a pair of guide sleeves (60*a*, 60*b*) that are mounted on said second housing and that have guide passages (70*a*, 70*b*) extending primarily along a pair of side axes (32, 34) and that are designed to receive said pair of guide pins;

said guide pins and guide sleeves each being mountable to a corresponding one of said housings at each of a pair of side axes (56, 72) that are laterally (L) spaced apart;

said first housing has passage walls forming a pin guide receiver (80) centered on a corresponding side axes 22 and having a plurality of radial recesses (81-84) in the receiver;

said guide pins (50*a*, 50*b*) each has a shaft (54) that fits closely in one of said pin guide receivers and has a pin front end (52) that projects forward of said shaft, said shaft and said pin front end being offset (C) from each other;

each of said pin guides has a radially outward projection (88) that projects into one of said radial recesses (81-84), to thereby laterally shift the pin guide front end with respect to the corresponding side axis (22, 24).

2. An electrical connector system that includes a plug connector (12) and a socket connector (14) wherein said connectors are each settable in the field to be mateable to each other but not be mateable to other similar connectors that are not correspondingly set, wherein each of said connectors has a housing (21, 36) with a housing axis (20, 30), and each of said connectors has a pair of laterally-spaced side axes (22, 24; 32, 34) lying on laterally opposite sides of its housing axis, wherein:

one of said connectors (14) has a pair of pin guides (50*a*, 50*b*) that each has a rear mount part centered on one of said pair of side axes and that each has a front end (52) that extends parallel to but is offset a distance (C) from the corresponding side axis, and the other connector has a pair of sleeve guides (60*a*, 60*b*) with rear ends (64) extending parallel to said side axes (32, 34) to receive said pin guides when the sleeve guides are aligned with the pin guides, said sleeve guides having offset pin-receiving sleeve front ends (62) that are offset a distance (D) from the corresponding side axes (32, 34);

of said pin guides and sleeve guides, the spacing (A, B) between a pair of guides of at least one of said connectors is adjustable by shifting both guides (50*a*, 50*b*, 60*a*, 60*b*) of said pair towards or both away from the corresponding housing axis.

3. The connector system described in claim 2 wherein:

said socket connector housing has a pair of passages (80) with cylindrical rear passage parts that each closely receives one of said sleeve guide rear mounts (64, 65), said passages having front passage parts that each has at least three radially outward recesses (81, 84) that are angularly spaced about the corresponding side axis;

said sleeve guides each has a cylindrical shaft (64) that lies closely in one of said rear passage pads (80) and that has a front sleeve passage (70) that is offset from an axis (32) of said cylindrical shaft, and that has a projection (94) that projects into one of said radially outward recesses.

4. An electrical connector system comprising:

a first housing (21) having a first side axis (22) extending in forward-rearward longitudinal directions (F, R), said housing having a recess with a primarily cylindrical rear recess part (80) that extends along said first side axis;

a first guide pin (50*a*) which has a first primarily cylindrical rear mount part (54) that lies in said rear recess part, said guide pin having a primarily cylindrical front pin part (52) that has a pin axis (56) that is parallel to, but offset a distance (C) from said side axis;

said guide pin having a radial projection (88) and said recess having a plurality of radial cutouts (81-84) that each can receive said radial projection;

said guide pin being moveable in a longitudinal direction (F, R) to move said radial projection out of one of said radial cutouts, said guide pin then being rotatable by a fraction of a full circle, and said guide pin then being moveable longitudinally to move said radial projection into another of said radial cutouts, to thereby shift said front pin part perpendicular to said side axis.

5. The electrical connector described in claim 4 wherein:

said radial projection is part of a cylinder, and said radial cutouts are each part of a cylinder that closely fits in one of said radial projections.

6. The electrical connector system described in claim 4 wherein:

said first housing has a first housing axis (20) and has a pair of side axes (22, 24) that include said first side axis, said side axes lying on laterally (L) opposite sides of said first housing axis, and said first housing having a rear recess part (80) of the same construction as said first rear recess part and lying on said second side axis; and including a second guide pin (50*b*) of the same construction as said first guide pin and which lies in said second rear recess part (80) and which has a front pin part (52) that projects forward primarily along said second side axis, said second guide pin having a second front pin part which is offset from said second pin axis.

* * * * *